US008702229B2

(12) United States Patent
Ortmann et al.

(10) Patent No.: US 8,702,229 B2
(45) Date of Patent: Apr. 22, 2014

(54) MODULAR PRINTING APPARATUS WITH A REMOVABLE, BOX-SHAPED MODULE

(75) Inventors: Axel Ortmann, Berlin (DE); Wolfgang Muhl, Neuendorf (DE); Dieter Woelm, Ludwigsfelde OT Gross Schulzendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 246 days.

(21) Appl. No.: 13/294,373

(22) Filed: Nov. 11, 2011

(65) Prior Publication Data

US 2012/0147071 A1 Jun. 14, 2012

(30) Foreign Application Priority Data

Nov. 11, 2010 (DE) ..... 20 2010 015 354 U

(51) Int. Cl.
*B41J 2/165* (2006.01)
*B41J 29/13* (2006.01)

(52) U.S. Cl.
USPC ..... 347/108; 347/36

(58) Field of Classification Search
CPC ..... B41J 2002/1721; B41J 2002/165; B41J 2002/16505; B41J 2002/16508; B41J 2002/16511; B41J 2002/16517
USPC ..... 347/36, 108
See application file for complete search history.

(56) References Cited

U.S. PATENT DOCUMENTS

| | | | |
|---|---|---|---|
| 2005/0134666 | A1 | 6/2005 | Rousseau |
| 2007/0120886 | A1 | 5/2007 | Turner et al. |
| 2009/0152802 | A1 | 6/2009 | Hantel et al. |
| 2009/0153609 | A1 | 6/2009 | Muhl |
| 2009/0153636 | A1 | 6/2009 | Hantel et al. |
| 2009/0153637 | A1 | 6/2009 | Muhl et al. |
| 2009/0218271 | A1 | 9/2009 | Harada |

*Primary Examiner* — Julian Huffman
(74) *Attorney, Agent, or Firm* — Schiff Hardin LLP

(57) ABSTRACT

A modular printing apparatus has a printing device with an inkjet print head and a box-shaped module that urges items toward the print head, for printing thereon. In an operating mode, the box-shaped module is inserted into the printing apparatus via a mechanical connection and can be removed from the printing apparatus in a service mode. A triggering mechanism acts on a locking mechanism with first and second force components that couple the locking mechanism and the mechanical connection element to one another in the operating mode to lock the box-shaped module in a bay of the printing apparatus at the printing apparatus. The second force component acts in an opposite direction in the service mode, to disengage the locking mechanism and the mechanical connection element to unlock and remove the box-shaped module.

11 Claims, 6 Drawing Sheets

MODULAR PRINTING APPARATUS WITH A REMOVABLE, BOX-SHAPED MODULE

BACKGROUND OF THE INVENTION

1. Field of the Invention

The invention concerns a printing apparatus of modular design with a removable, box-shaped module. As used herein, a printing apparatus is an apparatus that is equipped to print on flat items during the passage of the flat items through the apparatus. In the case of a jam of the flat items to be printed in the transport path and disruptions of the passage of the flat items, the invention allows a removal of the box-shaped unit from the printing apparatus for the purpose of cleaning the sensors and the transport elements and to empty the ink capture reservoir, as well as for maintenance of the transport unit of the printing apparatus. The invention is suitable for use in franking machines, mail franking systems and other printing apparatuses or mail processing systems.

2. Description of the Prior Art

A transport device for flat items to be printed is known from European Patent Application EP 2072272 A2. That transport device has a driven transport belt driven on rollers, with the transport belt supported on a support plate. The flat items to be printed are pressed from below, counter to the force of gravity, onto the transport belt in the support region by means of support bars. During printing, the flat items are transported in the transport direction past at least one print head of a printing module and are pushed from above through a print window by means of the print head. The print window is arranged in a housing part of the printing apparatus at the edge of the transport belt.

A device to press flat items onto a transport module is known from European Patent Application EP 2072268 A2, wherein a support receptacle for pressure elements is arranged below a feed table and at least one of the pressure elements with a number of individually resiliently supported components is installed on the support receptacle, or wherein a number of pressure elements are arranged below the transport belt on the support receptacle, in the transport direction.

A device to spray an inkjet print head clear of accumulated ink is known from European Patent Application EP 2072263 A2 that has a feed table with a shaft support that can be deflected counter to an elastic force, the shaft support being equipped with at least one clearance shaft.

A device to spray an inkjet print head clear of accumulated ink that is used in Centormail® franking machine is known from German Published Application 102005052151 B3. The excess or ejected ink is absorbed by a mat of the ink capture reservoir, so the mat becomes full of ink, which is why the content of the ink capture reservoir is also called an ink sump. The ink sump is arranged below a cleaning and sealing station and is designed as a plug-in unit. Access to the ink sump takes place via a separate tray.

A device to press flat items onto a transport module is known from European Patent Application EP 2072271 A2, in which the pressure device is installed in a lower housing shell and is equipped with lowerable pressure elements that act on the flat item to be printed with an elastic force through an opening in a feed table for flat items. An actuation element that activates a lowering device to which the pressure elements are attached is arranged on the lower housing shell. The lowering still does not allow any access to the sensors, transport elements and pressure elements, but allows access to the inkjet print heads. Contact with the print heads could lead to an interfering electrical charge.

Known solutions for a franking machine implement a downward lowering or folding of the lower transport unit in order to correct an occurring paper jam. There is a risk of injury for an operator who may insert his or her fingers into the franking machine in order to clear the jam. Access to the sensors, transport elements and pressure elements, however, continues to be difficult or impossible.

Access to the ink sump likewise takes place via a separate bay. If the operator has forgotten to reinsert the sump shell after changing the mat, however, this can lead to contamination of the environment of the machine and of the machine itself.

SUMMARY OF THE INVENTION

An object of the invention is to provide an arrangement that enables maintenance of a printing apparatus without the disadvantages that occur in the prior art. An operator of the printing apparatus should have the capability to exchange the mat in the ink sump, to exchange the elements of the pressure unit, and to clean the transport path. Access to the sensors should also be enabled and debris removal should be facilitated. Contact with (and thus an electrical charging) of the inkjet print heads should be avoided and the risk of injury to the operator should be reduced. Moreover, dryout of the inkjet print heads during the maintenance should be prevented.

A printing apparatus of modular design in accordance with the invention allows removal of a box-shaped module and has the following features:

A printing device has a movable print carriage in which at least one inkjet print head is installed. A control unit of the printing apparatus is programmed to switch from an operating mode into a service mode and to activate a motor to displace the print carriage in the y-direction transversely to the transport direction x of flat items to be printed. This activation is continued (maintained) after the switching until a sealed position has been reached by the at least one inkjet print head. In this sealed position a dryout of the inkjet print head is prevented by a cleaning and sealing station. The printing apparatus has a locking mechanism and a mechanical connection element integrally molded on a housing wall of the box-shaped module. The box-shaped module is inserted into the printing apparatus in the operating mode and can be removed from the printing apparatus in the service mode. A triggering mechanism acts on the locking mechanism with first and second force components. The locking mechanism and the mechanical connection element engage one another via the first force component that is active in the z-direction in the operating mode in order to lock the box-shaped module, inserted into the printing apparatus at said printing apparatus. The locking mechanism and the mechanical connection element are disengaged from one another via the second force component that is active counter to the z-direction in the service mode, in order to unlock the box-shaped module inserted into the printing apparatus before the box-shaped module can be removed from the printing apparatus.

The printing apparatus has an upper housing shell below which are arranged a lower housing shell and a box-shaped module that adjoin one another. The latter is removable depending on predetermined conditions. In the operating mode, the box-shaped module is locked by a locking means and cannot be removed. The box-shaped module that is to be inserted into the printing apparatus is a compact unit that can be removed by the operator, and includes a feed table for flat items, with an opening for a number of pressure elements of a pressure unit, with openings for guides and with one clearance shaft per inkjet print head, with an integrally molded ink sump reservoir and with a lowering device to lower the pressure unit. The box-shaped module is directed like a drawer by guidance means upon insertion and, in the service mode, enables an easy access to the ink sump and to the pressure unit.

In the operating mode, thus when the box-shaped module is not removed, the access to some assemblies is at least hindered and no access exists to either an inkjet print head or the transport belt, or to sensors in the transport path of the printing apparatus. The control unit that is provided to switch from the operating mode to the service mode waits for a user input via a user interface. For example, a switch to the service mode takes place after operation of an actuator. The locking mechanism is unlocked in the service mode by the triggering mechanism in order to release the box-shaped module. In the service mode the transport unit of the printing apparatus is deactivated. Due to removal of the box-shaped module, both the transport belt and the transport path of the printing apparatus (and the assemblies of the box-shaped module) are accessible.

The box-shaped module is supported on two guidance means that protrude forwardly through first and second openings on the front side of the lower housing shell. The upper housing shell encloses the transport unit, i.e. the drive unit with a transport belt opposite which a lowerable pressure device of the box-shaped module is situated in the event of operation.

During maintenance, the box-shaped module is designed so that it can be moved or shifted away from the lower housing case and thereby runs on the two guidance means that protrude at the lower housing shell. Depending on the occurrence of predetermined conditions, the module can be removed from the printing apparatus (a franking machine, for example) by the operator, which affords an accessibility to the sensors in the transport path and their maintenance or first enables a cleaning of the transport path. The box-shaped module has an ink sump reservoir. this is a large ink reservoir for the capture of ink that accumulates as waste material in the region of the cleaning and sealing station during the clearance cycles and in the printing region during the passage of goods. The ink reservoir is designed as a container that protrudes at the back of the box-shaped module, with an internally inlaid ink mat which, during operation, protrudes into a third opening on the front of the lower housing shell.

The first opening is arranged upstream (in terms of the mail flow) near the left side wall of the apparatus. The second opening is arranged downstream (in terms of the mail flow) near the right side wall of the apparatus, and the third opening is arranged to the left next to the second opening.

The guidance means that protrude from the lower housing shell are supported by a first frame wall that is likewise arranged in the lower housing shell at a distance from the rear frame wall. The first frame wall has a corresponding opening in order to support the first guidance means.

A second frame wall is arranged orthogonally to the rear frame wall and proceeds near the center of the lower housing shell in order to connect the first frame wall with the rear frame wall. The second frame wall is designed as elbow that is attached vertically with one of the two legs in the lower housing shell and protrudes with the respective other leg into the upper housing shell up to its forward region. The leg attached vertically in the lower housing shell has a maximum width that corresponds to the aforementioned distance and a height that exceeds the height of the lower housing shell.

A fourth opening is arranged to the left, next to the third opening on the front side of the lower housing shell. The first frame wall has two corresponding openings that are situated on the back of the front side of the lower housing shell opposite the respective third and fourth opening. The box-shaped module has a mechanical connection element protruding at the back side, which mechanical connection element protrudes into the fourth opening in the event of operation. The module remains locked by the mechanical connection element and the locking mechanism during the printing process. The module can be removed by the operator only when, after the control unit switches from the operating mode into the service mode, the motor is activated and the print carriage is driven into a sealed position by driven arrangement coupled with the motor. A cleaning and sealing station prevents the inkjet print heads from drying out in the sealed position. This is particularly advantageous in a rest phase and when the module is removed for a longer duration. It is advantageous that, after removing the box-shaped module, an operator cannot emit an electrical discharge to the print head electronics at the print head moved into the sealed position, which discharge could destroy the print head electronics.

The locking mechanism is unlocked when the print carriage arrives in the sealed position. The movement of the print carriage that is controlled by a control unit acts on a locking means by a triggering means. A first sensor is operationally connected with a microcomputer via an input/output unit of the control unit in order to determine whether the print carriage is located in the sealed position. If the print carriage arrives in proximity to this, a first switching point is crossed in order to cancel the locking of the module via the locking means while the microcomputer additionally activates the motor until the sealed position is reached.

In all other cases the module remains locked if the print carriage is not in proximity to the sealed position and the first switching point has thereby not been crossed.

After removal of the module, the operator now also has access to the sensors in the transport path for the purpose of cleaning them and to correct a jam of the flat items, for example of mail pieces (letter jam).

Given a removed module, an exchange of the ink mat by the operator and an exchange of the lower transport unit (brush) by the operator are possible.

A first sensor (photoelectric barrier or microswitch) can be arranged at a first position in order to emit a signal to the control unit depending on the position of the triggering mechanism or of the print carriage.

An additional switch is arranged at a suitable point within the apparatus in order to detect a presence of the ink sump reservoir with properly closed cover and to interrupt the current flow if this is not present. A software error thus could not lead to an unintentional shifting of the print carriage when the module is not inserted into the apparatus. The risk of injury to the operator is thus reduced when the module is removed.

Moreover, the unused apparatus transitions into a standby mode after a predetermined period of time. A circuit closer is connected to the power supply unit in order to trigger a reactivation of the power supply of the apparatus before switching into the operating mode.

The ink sump reservoir is oblong in shape and thereby extends in the y-direction, and should be provided with a cover that allows only specific regions to be open and prevents the mat from falling out.

The preferred embodiment allows a reactivation of the power supply of the apparatus and a switching into the operating mode only when the cover has been placed to cover the ink sump.

Embodiments of the ink sump reservoir are possible in which the ink sump shell is permanently arranged in the box-shaped module and filled with a mat, or in which a separate mat shell is used.

DESCRIPTION OF THE PREFERRED EMBODIMENTS

Figure 1A:
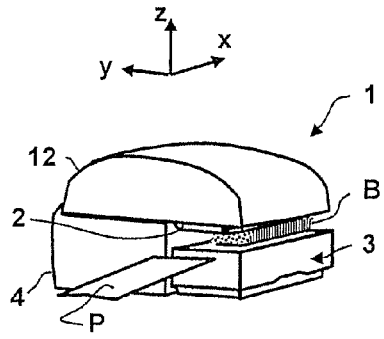
FIG. 1*a* is a perspective schematic illustration of a printing apparatus with an inserted box-shaped module.

A printing apparatus 1 given an inserted, box-shaped module 3 in a basic perspective view is shown from the upper front left in FIG. 1*a*. The printing apparatus has an upper housing shell 12, below which a lower housing shell 4 is shown abutting the box-shaped module 3 in the y-direction. The upper housing shell 12 is mounted on the lower housing shell 4 such that it cannot be detached non-destructively in the z-direction. The lower housing shell 4 forms a rear lower part of the printing apparatus and forms a seal with the upper housing shell at the rear and to the sides. The box-shaped module 3 that can be removed only in service mode in the manner of a drawer is accommodated in the forward lower part of the printing apparatus and has a plurality of pressure elements B. In the front part, below the upper housing shell 12, a transport belt 2 of a transport unit is visible which serves to transport mail pieces in the x-direction (transport direction) in the printing mode, wherein the x-, y- and z-directions form a Cartesian coordinate system. The pressure elements B press a flat piece P to be printed onto the transport belt 2 from below (thus in the z-direction) as soon as the piece P is supplied to the printing apparatus 1. The printing mode is a special operating mode of the printing apparatus in which the at least one inkjet print head is positioned in the forward part of the upper housing shell 12.

Figure 1B:
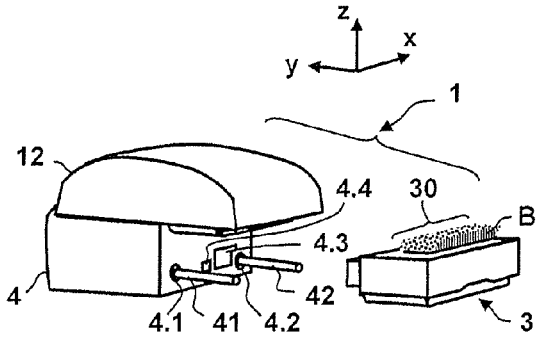
FIG. 1*b* is a perspective illustration of a printing apparatus with a removed box-shaped module.

In FIG. 1*b* a printing apparatus 1 is shown with a pulled-out, box-shaped module 3, in a perspective view from above and to the left. In contrast to the printing mode, in the service mode the at least one inkjet print head is positioned in the rear part of the upper housing shell 12 after it was moved there (transversal to the transport direction, thus in the y-direction). The box-shaped module 3 is shown removed from the lower housing shell 4, which is why two guidance means 41 and 42 are visible. The latter are designed as rails on which the box-shaped module is supported in the operating mode. They protrude forwardly through a first opening 4.1 and second opening 4.2 on the front side of the lower housing shell.

A third opening 4.3 and fourth opening 4.4 are situated between the first opening 4.1 and second opening 4.2. The first opening is arranged upstream (in terms of the mail flow) near the left side wall of the apparatus, the second opening is arranged downstream (in terms of the mail flow) near the right side wall of the apparatus, and the third opening is arranged to the left next to the second opening. The pressure elements B are a component of a lowerable pressure device 30 of the box-shaped module 3 that moreover has an ink reservoir whose arrangement is explained in the following using FIG. 2*a*.

Figure 2A:
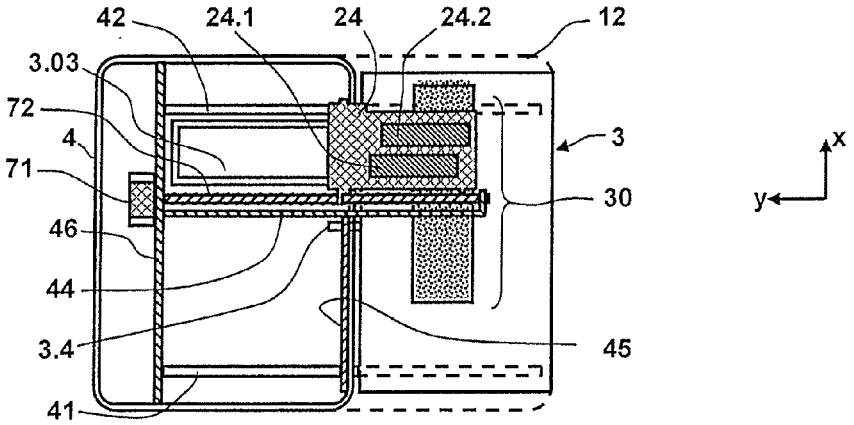
FIG. 2*a* is a plan view of the printing apparatus in section parallel to the x/y-plane with an inserted, box-shaped module and removed upper housing shell.

A plan view of the printing apparatus (shown in section parallel to the x/y-plane) with an inserted box-shaped module 3 (thus in the operating case) is shown in FIG. 2*a*. The removed upper housing shell 12 is drawn in dashed lines in order to clarify its position. The box-shaped module 3 has at its rear side a mechanical connection element 3.4 and an ink reservoir 3.03, wherein the mechanical connection element 3.4 is designed as a hook that protrudes into the fourth opening on the front side of the lower housing shell 4. The box-shaped module 3 is equipped with a feed table that has an opening at the top side for the pressure elements of the pressure device 30. The latter is known from European Patent Application EP 2072268 A2, in which the "Device for pressing flat goods onto a transport module" is described in more detail.

The print carriage 24 has a first and second cavity 24.1 and 24.2 for insertion of a respective ink cartridge. The upper housing shell 12 has a transport unit (drive unit with a transport belt) that is attached to a chassis, as described in part in European Patent Application EP 2072272 A2 with the title: "Transportvorrichtung für zu bedruckende flache Güter" ("Transport device for flat goods to be printed").

A print carriage 24 (drawn in the printing position) can be moved in the y-direction via a spindle drive (comprising a part of the print carriage, not shown in detail, and a spindle 72) by a motor 71 attached to a rear wall of a chassis. The rear frame wall 46 serves for attachment of the rails on which the print carriage 24 runs, as is known from the European Patent Application EP 2072272 A2. For better clarity, in FIG. 2*a* only the guidance means for guidance of the box-shaped module are shown, and the aforementioned rails on which the print carriage 24 runs are omitted.

The rear frame wall 46 serves at least to support and possibly also for the attachment of both the first rail 41 and the second rail 42. A first frame wall 45 has a corresponding opening in order to support the first rail 41. A second frame wall 44 is arranged orthogonal to the rear frame wall 46 and runs near to the center of the lower housing shell 4 in order to connect the first frame wall with the rear frame wall. The second frame wall 44 is designed as an elbow that is attached vertically with its one leg in the lower housing shell, and protrudes with its other leg in the upper housing shell up to its front region. The leg attached vertically in the lower housing shell has a width that corresponds to the aforementioned distance and a height that projects beyond the height of the lower housing shell. A perspective presentation of the second frame wall 44 is shown in more detail in European Patent Application EP 2072272 A2.

The ink reservoir 3.03 is designed as a container with an inlaid ink mat that projects at the back side at the drawer 3. This container extends into the third opening on the front side of the lower housing shell 4 in the inserted state.

Figure 2B:
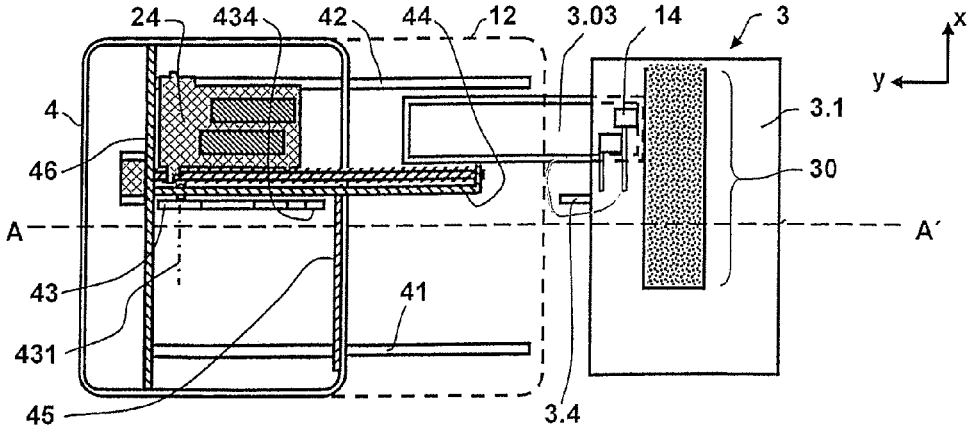
FIG. 2*b* is a plan view of the printing apparatus presented in section parallel to the x/y-plane with a removed, box-shaped module and removed upper housing shell.

A plan view of the printing apparatus 1 (shown in section, parallel to the x/y-plane) is shown in plan view in FIG. 2*b* given a removed, box-shaped module 3—i.e. in service mode—and given a removed upper housing shell. The position of the removed upper housing shell 12 is indicated again in dashed lines. The print carriage 24 (that is not shown with dashed lines) is located in the sealed position. A hook as a mechanical connection element 3.4 and an ink reservoir 3.03 are integrally molded on the rear side of the box-shaped module 3. An opening for the pressure elements of the pressure device 30 is formed on the top side of the box-shaped module 3 in the feed table. In the operating mode the ink reservoir 3.03 is situated between the second rail 42 and the second frame wall 44 which are mounted on the rear frame wall 46 which stands in the lower housing shell. The ink reservoir 3.03 extends to below the pressure device 30 (which was indicated with dashed lines). Located below each of the inkjet print heads in the printing region is a clearance shaft on a shaft support 4 that can be deflected counter to a resilient force. Details in this regard are described in European Patent Application EP 2072263 A2 with the title: "Vorrichtung zum Freispritzen eines Tintendruckkopfes" ("Device for clearing an inkjet print head"). Provided on the left side of the second frame wall 44 is a locking mechanism 43 that is mounted so that it can rotate around a rotation axis 431 on the end thereof facing toward the rear frame wall 46 and has a hook 434 at the other end (facing toward the first frame wall 45). The function of the hook 434 is explained in the following using FIG. 3*a*, which shows a section through the printing apparatus on the line AA' of FIG. 2*b*.

Figure 3A:
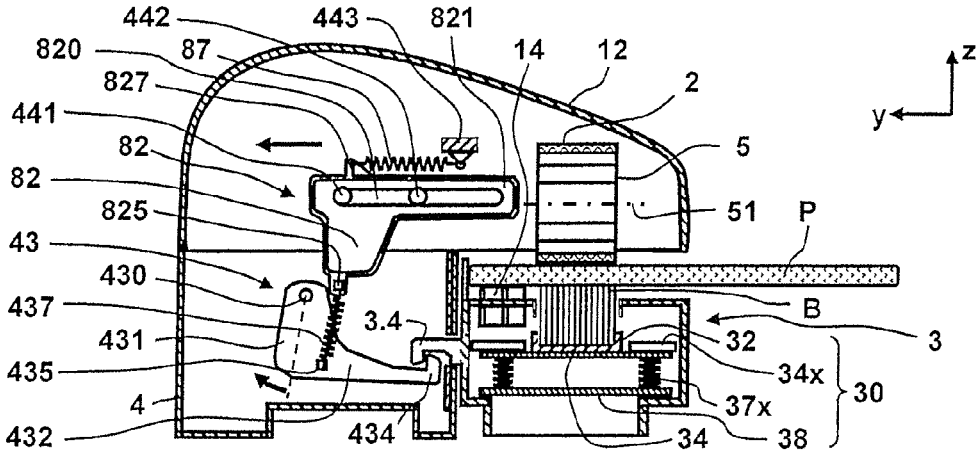
FIG. 3*a* is a side view from the left of printing apparatus shown in section parallel to the y/z-plane given an inserted box-shaped module, in operating mode; section through the printing apparatus at the line AA' of FIG. 2*b*.

FIG. 3*a* shows a side view from the left of the printing apparatus (shown in section parallel to the y/z-plane) in the operating mode given an inserted box-shaped module. Below the upper housing shell 12 the transport belt 2 runs around a roller 5 that is arranged near the printing region and near the mail flow outlet. The roller is rotatable around a rotation axis which is situated parallel to the y-direction. An additional roller for the transport belt that is arranged near the printing region and near the mail flow inlet is not shown (since it is cut away). The drawn slice plane which lies parallel to the y/z-plane is arranged in the region counter to the x-direction, thus before the printing region. A slider 82 that serves as a triggering mechanism for a locking mechanism 43 is shown in the slice plane in the region situated after the transport belt in the y-direction. The slider 82 is designed as a flat elbow and is held in the indicated (second) position by a return spring 87. The return spring 87 is designed as a tension spring.

The slider 82 is mounted at the second frame wall (not drawn in FIG. 3*a*) such that it can be displaced in the arrow direction counter to the tension spring force. The return spring 87 is attached with its one end at a first attachment segment 827 of the slider 82 and is attached with its other end at the attachment segment 442 of the chassis. The slider 82 has one leg 821 with an oblong hole 820 which extends parallel to the y-direction. Two guide pins 441 and 442 are attached at the second frame wall and protrude though the oblong hole 820.

The end of the oblong hole that faces toward the rear wall of the upper housing shell 12 lies near the first attachment segment 827 of the slider 82. The first attachment segment 827 is integrally molded in the z-direction on the one side of the leg 821 and has an opening for attachment of the tension spring. A base is integrally molded approximately at a right angle on the opposite side of the leg, counter to the z-direction. The end of the base that is remote from the leg 821 supports an additional attachment segment 825 for the attachment of the one end of an additional tension spring 437. Its other end is attached at an attachment segment 435 of the locking mechanism 43. The locking mechanism 43 is designed as an angle lever and arranged in the region of the lower housing shell 4. The pivot of the angle lever lies in an opening 430 at the remote end of the first leg 431. A hook 434 whose tip extends in the z-direction is integrally molded at the end of the second leg 432 of the angle lever. The slider 82 of the apparatus reaches a second position as is presented in principle in FIG. 3*a*. The tension spring 437 attached at the additional attachment segment 825 of the slider 82 then exerts a tension force with a component in the z-direction on the locking mechanism 43 and with an additional component that is directed counter to the z-direction. In the operating mode the hook 434 therefore engages in the mechanical connection element 3.4 which is integrally molded on the outside of the back side of the box-shaped module 3. The mechanical connection element 3.4 is designated as a hook, but this does not preclude other, alternative mechanical connection elements (such as eye hooks, tongues or box-shaped hooks reinforced by side walls or others). In the shown position the angle lever can be rotated clockwise—i.e. in the direction of the black arrow—around its pivot when the triggering mechanism is operated.

As used herein, a flat it can be, for example, a piece of mail. A mail piece P which has been supplied to the apparatus is clamped between the transport belt 2 and the pressure elements B of the lowerable pressure device 30 of the drawer 4 and transported in the transport direction (x-direction) by the further movement of the transport belt during the printing. The pressure elements B are attached on a support 32 which is mounted elastically on a floor plate 38 which is reinforced in the downward direction on the housing of the drawer. For example, a guidance element 34*i* and an associated compression spring 37*i* are provided at the corners of a base 34 in order to also be able to process larger thicknesses of the mail pieces P. The attachment segment 435 is integrally molded near the middle of the angle lever 43 and counter to the transport direction (x-direction). The shaft support 14 that can be deflected counter to an elastic force (the manner is not shown) is deflected corresponding to the thickness of the mail piece P.

Figure 3B:
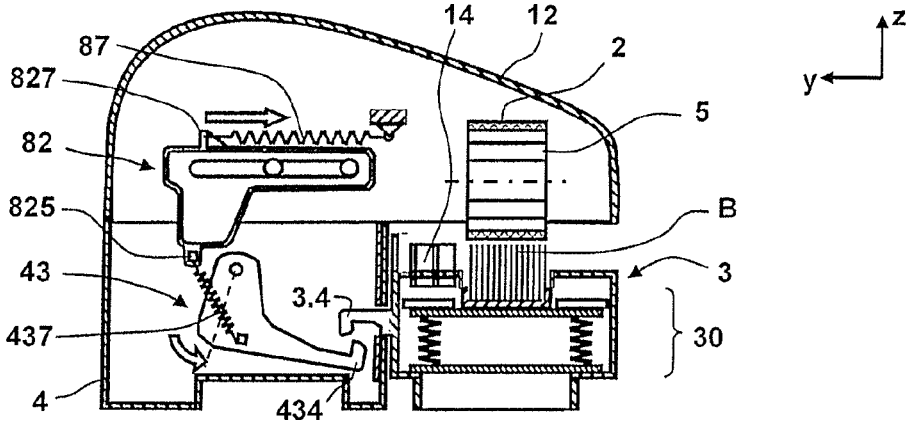
FIG. 3*b* is a side view from the left of printing apparatus shown in section parallel to the y/z-plane with an inserted box-shaped module, in service mode.

FIG. 3*b* shows a side view from the left of the apparatus (shown in section parallel to the y/z-plane) with inserted drawer in the service mode. In the service mode the slider 82 of the apparatus reaches a first position in which the return spring 87 attached at the attachment segment 827 is tensioned, as is presented in principle in FIG. 3*b*. The tension spring 437 attached at the attachment segment 825 of the slider 82 is also tensioned and now exerts a pulling force with a component counter to the z-direction on the locking mechanism 43. The pulling force acts with an additional component that is directed in the y-direction. The locking mechanism 43 therefore causes the hook 434 to be unlocked from the mechanical connection element 3.4 of the drawer 3. The transport belt 2 is diverted around the roller 5 of the upper housing shell 12, said roller 5 being is arranged at the side of the mail flow outlet. In this position the angle lever is rotatable counterclockwise around its pivot, i.e. in the direction of the white arrow, when the triggering mechanism is operated.

In the absence of a mail piece, the deflectable shaft support 14 is deflected just as much as the pressure elements B of the lowerable pressure device 30 of the drawer 3.

Figure 4:
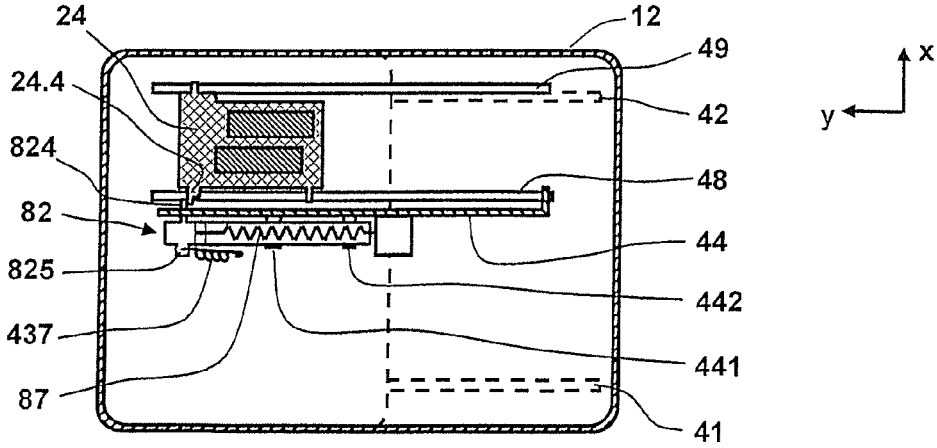
FIG. 4 is plan view of the apparatus sectioned parallel to the x/y-plane through the upper housing shell, without box-shaped module.

FIG. 4 shows a plan view of the apparatus (in section through the upper housing shell parallel to the x/y-plane) without the drawer. The position of the guidance means 41 and 42 arranged below the upper housing shell is only indicated. Therefore they are only indicated with dashed lines. The transport belt and the rollers that are arranged in the upper housing shell 12 were likewise omitted for better clarity. Rather, what is shown is the position of the rails 48 and 49 on which the print carriage 24 runs when it is moved in the sealing position, for example. Integrally molded on the print carrier 24 is a carrier 24.4 which acts on the projection 824 integrally molded on the slider 82 to shift the slider into the sealed position (position I) upon travel of the print carriage. A slit through which the projection 824 extends in the x-direction is worked into the second frame wall 44 of the chassis. The slider 82 is directed by guide pins 441 and 442. Given movement of the print carriage into the sealed position, the carrier 24.4 entrains the projection 824 extending through the slit, whereby the return spring 87 is tensioned. However, the tension spring 437 is attached at the attachment segment 825 of the slider 82, which tension spring 87 now exerts a draw force in the y-direction on the locking mechanism as long as the print carriage 24 remains in the sealed position.

Figure 5A:
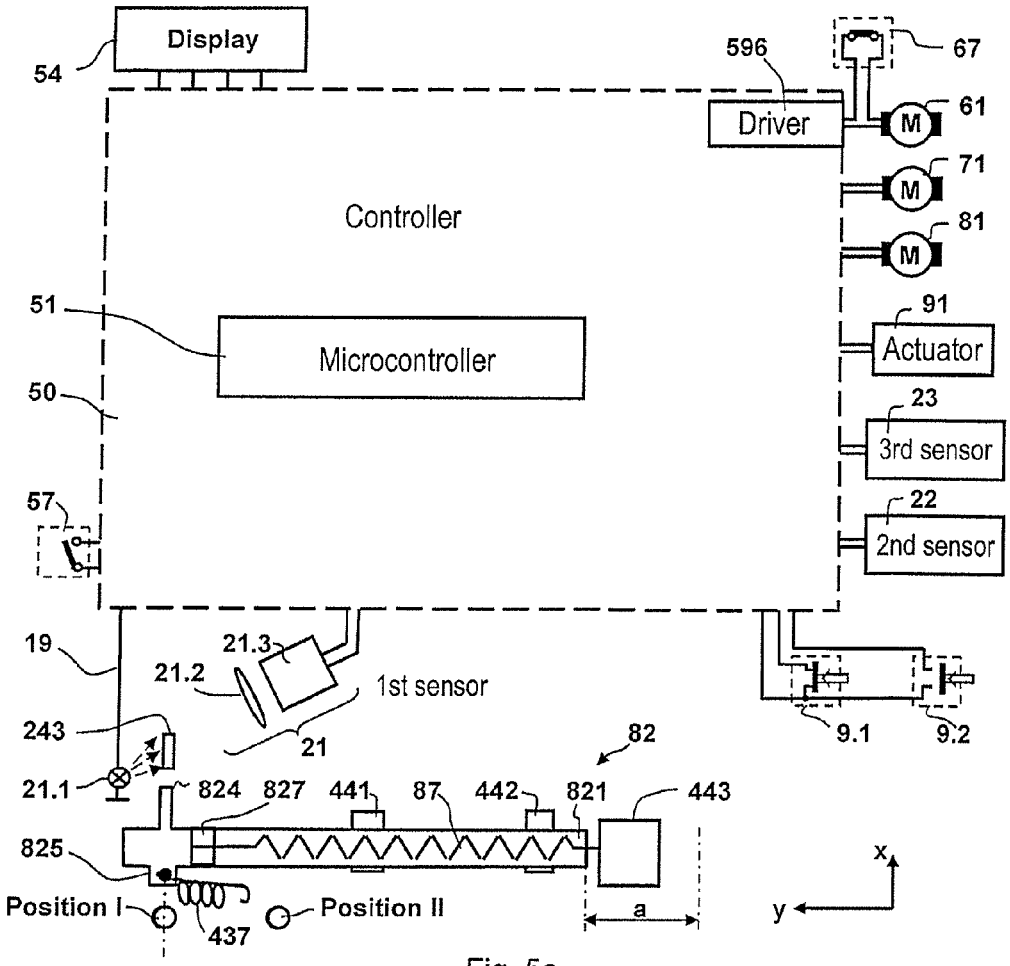
FIG. 5*a* is a circuit arrangement of an apparatus switched into a service mode.

FIG. 5*a* shows a circuit arrangement of the control unit of an apparatus switched into a service mode. The electronic control unit 50 comprises a microcomputer 51 which activates at least one driver 596 that is connected with a first motor 61 via a microswitch 67.

The control unit is programmed to switch into the service mode due to a corresponding user input via a user interface. A separate operating unit 9.1, 9.2 or a keyboard or a touchscreen can be used for this purpose. A circuit closer 57 is likewise connected to the control unit 50 in order to enable a return of the control unit 50 to the operating mode. A power supply unit can be arranged as an integrated component of the control unit 50 or can also be arranged separate (not shown) from the control unit 50 in the printing apparatus 1.

The control unit 50 is connected with input means, for example with sensors 21, 22, 23 and with at least one operating unit 9.1 for manual selection and one operating unit 9.2 to confirm an input. A display unit (display) 54, the motors 61, 71, 81 or, respectively, an actuator 91 are connected to the electronic control unit 50. The control unit 50 is programmed to switch into the service mode upon a user input via a user interface.

After switching from the operating into the service mode, the microcomputer 51 and, via a first driver 596, a first motor 61 are activated to shift the print carriage 24 transversal to the transport path of a flat good to be printed, wherein a first sensor 21 signals when a sealed position is reached by the at least one inkjet print head when the print carriage reaches a first position due to its movement in the y-direction. Upon removing the box-shaped module, the current flow of the first motor 61 is interrupted by the microswitch 67 so that no accidents due to a transversal shift of the print carriage can occur in the service mode.

A second sensor 22 and third sensor 23 are connected to the control unit 50 as well as a second motor 71. After the control unit 50 of the printing apparatus is switched into the operating mode, the second motor 71 is activated in a print mode to drive a transport belt of the printing device to print a flat good when the second sensor 22 signals the presence of a flat good and the third sensor 23 signals that a trigger position for a printing has been reached by the feed of the flat good.

The triggering mechanism is a slider 82 that is shown schematically and in plan view on the leg 821 (FIG. 5*a*). The top side of the leg is situated essentially parallel to the x/y-view. The slider 82 is directed via guide pins 441 and 442 that are attached so as to project on the left side of the second frame wall of the chassis (see also FIG. 4).

When the print carriage as reached the sealed position in the service mode, the end of the leg 821 is offset by a distance a in the y-direction and is situated near the attachment segment 443 of the return spring 87. The following integrally molded details are visible on the opposite end of the slider 82 in the y-direction: a projection 824 on the slider serves to shift the slider upon movement of the print carriage into the sealed position and is situated at a position I; an attachment segment 825 of the slider 82 to attach the tension spring 437; and an attachment segment 827 of the slider 82 to attach the return spring 87. The stressed tension spring 437 has a tensile force component that points in the y-direction and produces the unlocking.

For example, the first sensor 21 is realized as a transmitted light sensor, and a vane 243 integrally molded on the print carriage serves to interrupt a beam of light of the transmitted light sensor that is emitted from the light source 21.1. The light source 21.1 is connected via a conductor 19 to the input/output unit 59 for power supply. The light beam or, respectively, the remaining residual light is focused by the lens 21.2 onto a light detector 21.3. The latter emits an analog signal corresponding to the received light intensity, which analog signal is converted via a nonlinear electronic element into a digital signal. Upon exceeding an adjustable threshold of the analog signal, a digital signal (H-level) is output to the control unit 50. Given a ZERO level (no signal), the sealed position has been reached.

Figure 5B:
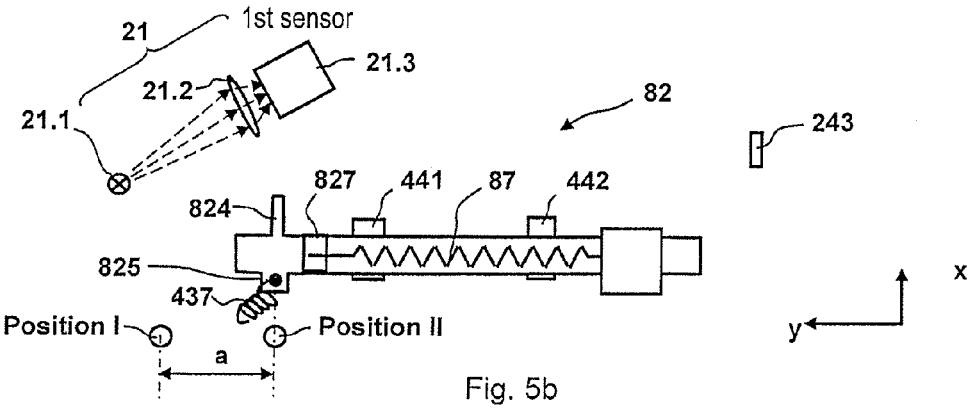
FIG. 5*b* shows detail of an apparatus that is switched into an operating mode.

FIG. 5*b* shows a detail of the apparatus that is switched into an operating mode, wherein the slider 82 is used as a triggering mechanism and the sensor 21 is used in the form of a transmitted light sensor. The vane 243 integrally molded on the print carriage cannot contribute to the deactivation of the first sensor 21 in this case. Due to the effect of the return spring 87, the slider 82 has been shifted so far counter to the y-direction that the projection 824 of the slider is situated in the position II. The light source 21.1 emits a light beam of maximum intensity that is focused by the lens 21.2 onto a light detector 21.3. The latter emits a maximum signal corresponding to the received light intensity. The projection 824 is active given the displacement of the slider upon movement of the print carriage from the indicated position II into the position I. The attachment segment 825 serves to attach the tension spring 437, and the attachment segment 827 serves to attach the return spring 87. The position I is situated at a distance a from the position II in the y-direction. The stressed tension spring 437 has a draw force component that points opposite the y-direction, which produces the locking.

Alternatively, the first sensor 21 can be realized as a microswitch, and the projection 243 serves to operate the microswitch.

Figure 6:
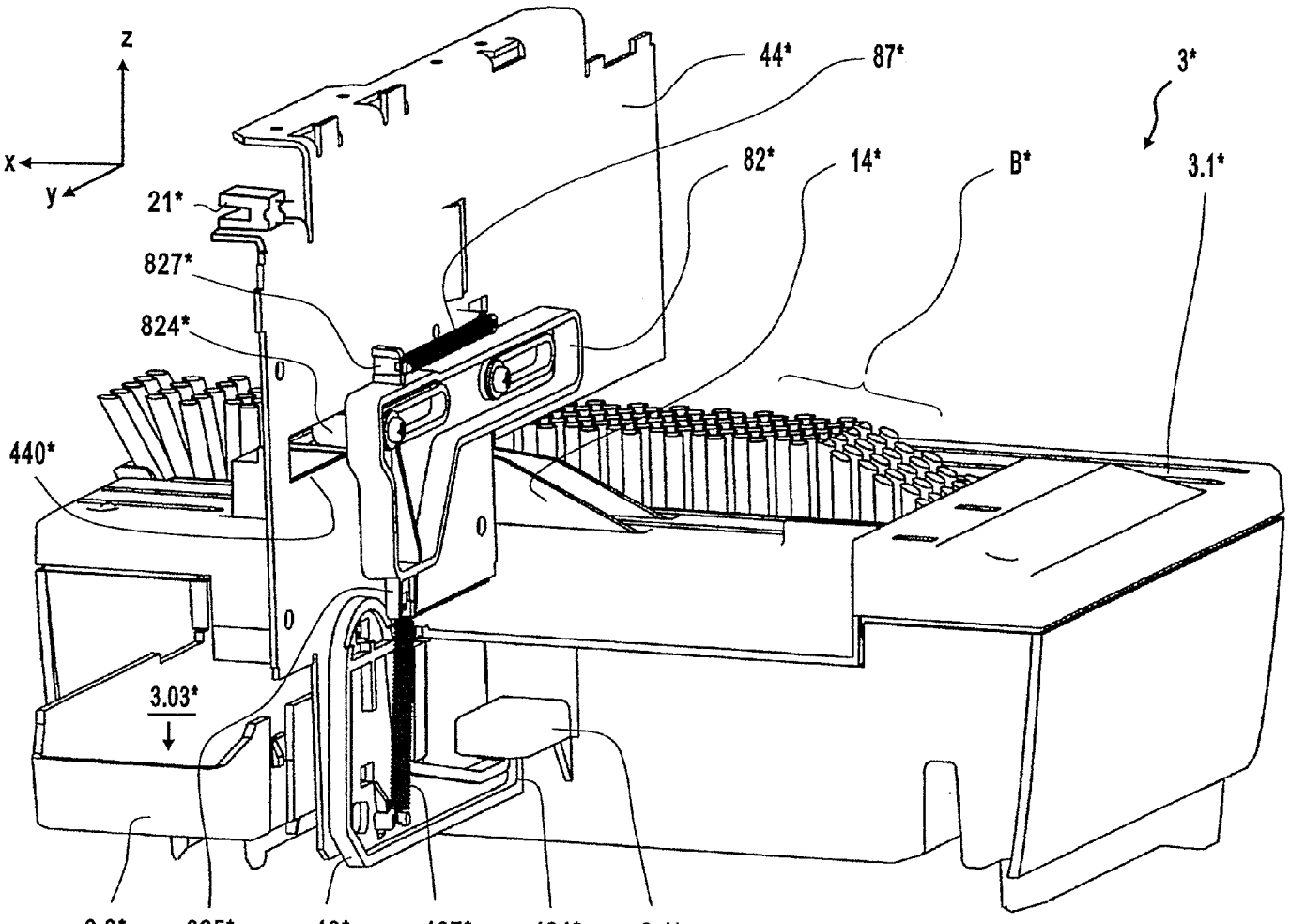
FIG. 6 is a perspective view of a detail of the apparatus from the rear right in operating mode, with the triggering mechanism and with the locking mechanism.

FIG. 6 shows a perspective representation of a detail of the apparatus from behind in the operating mode, with the triggering mechanism and with the locking mechanism. A slider 82* that acts on the locking mechanism 43* is used as a triggering mechanism. The slider 82* has two attachment segments 825* and 827* to attach the two tension springs 437* and 87* and a projection 824*. The projection 824* serves to displace the slider from the indicated position II into the position I during the movement of the print carriage (not drawn) into the sealed position. A slit 440* running in the y-direction is worked into the second frame wall 44* of the chassis, through which slit 440* the projection 824* protrudes in the x-direction and can be shifted in the y-direction together with the slider 82*. An elbow lever that, with its lever arm, locks the box-shaped module in the operating mode is used as a locking mechanism.

The pressure elements B* of the box-shaped module 3* lie near the deflectable shaft bearing 14* in the y-direction. The box-shaped module 3* bears on the rear side a box-shaped hook 3.4* in which the hook 434* on the lever arm of the locking mechanism 43* engages. Near the downstream (in terms of the mail flow) side of the box-shaped module 3*, an ink sump shell 3.3* extends in the y-direction on its back side. The latter has an ink reservoir 3.03* and a cover (not shown). A transmitted light sensor is used as a first sensor 21* that is directly activated by the print carriage (not drawn) as soon as the sealed position is reached.

Figure 7:
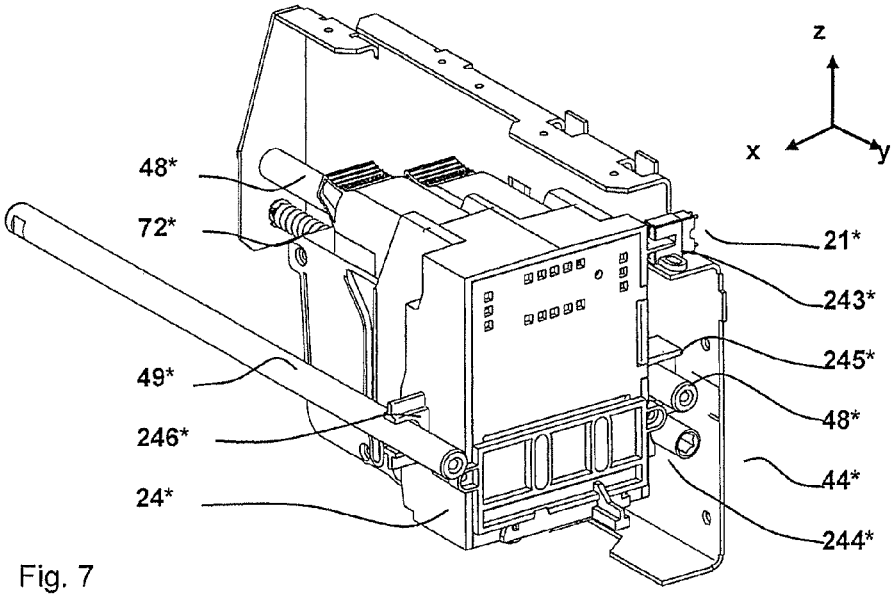
FIG. 7 is a perspective view of a detail of the apparatus from the rear left in service mode, with the print carriage in the sealed position and with a transmitted light sensor that is activated by the print carriage.

FIG. 7 shows a perspective view of a detail of the apparatus from the left and to the rear in the service mode, with the print carriage 24* in the sealed position and with the transmitted light sensor 21* that is operated by the print carriage 24*. A vane 243* is integrally molded on the print carriage, which vane 243* interrupts the light beam of the transmitted light sensor 21* when the sealed position is reached. The print carriage 24* moved into the sealed position is shown in FIG. 7. The print carriage 24* is arranged so that it can be displaced in the y-direction and counter to this on two rails 48* and 49*. A spindle 72* serves to drive the print carriage and is arranged below the rail 48*, thus counter to the z-direction. A slide bearing (not visible) and a slide bearing 245* as well as a spindle nut 244* are integrally molded on the right (as seen from the rear) side wall of the print carriage 24*, thus on that side that is nearest the second frame wall 44* given an inserted box-shaped module. An additional slide bearing 246* is integrally molded on the left side wall of the print carriage 24* that is situated opposite the right side wall. The displaceable print carriage 24* is thus borne at three points. The slide bearing 246* slides on the rail 49*, and the two other slide bearings slide on the rail 48*. The slide bearings are adapted to the profile of the rails. The rails are designed as slide rods and have a round (advantageously a circular) profile.

Figure 8:
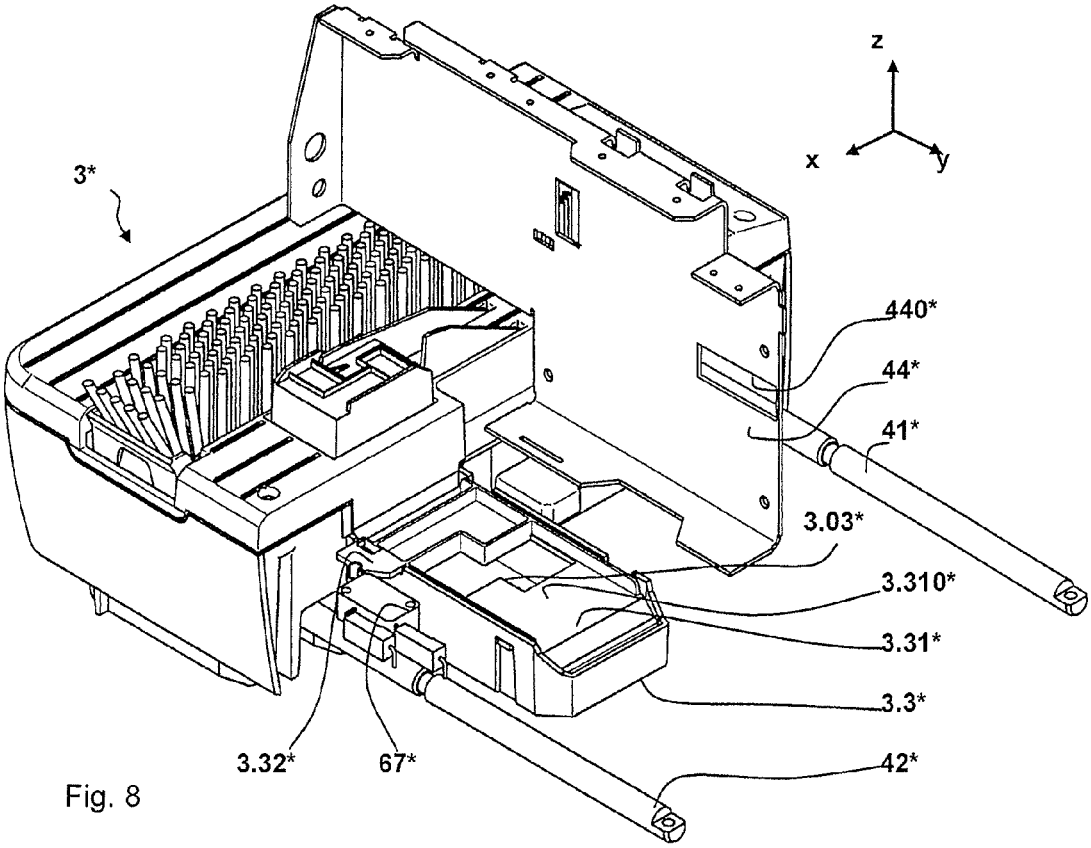
FIG. 8 is a perspective view of a detail of the apparatus without the print carriage.

FIG. 8 shows a perspective presentation of a detail of the apparatus from the left and to the rear with inserted box-shaped module 3*. Upon insertion the latter is attached (the manner is not shown) onto the guidance means 41* and 42*. The latter are advantageously realized as slide rods, but other designs are possible. A microswitch 67* is used as a sensor for the box-shaped module. The apparatus is switched from the service mode to the operating mode by the microcomputer as soon as the box-shaped module is inserted and the microswitch is operated by a vane 3.32* which is integrally molded on a cover 3.31*, wherein the cover is positively connected with the shell 3.3* and at least partially covers the ink reservoir 3.03* in spite of an opening 3.310*. The vane is integrally molded on the end of the cover 3.31* of the ink sump reservoir 3.3* (on the left side as viewed from the rear) that is situated in the y-direction, on that side that is furthest removed from the second frame wall 44* given an inserted box-shaped module. The latter has a window-like slit 440* through which the projection of the slider protrudes in the manner shown in FIG. 6.

Figure 9A:
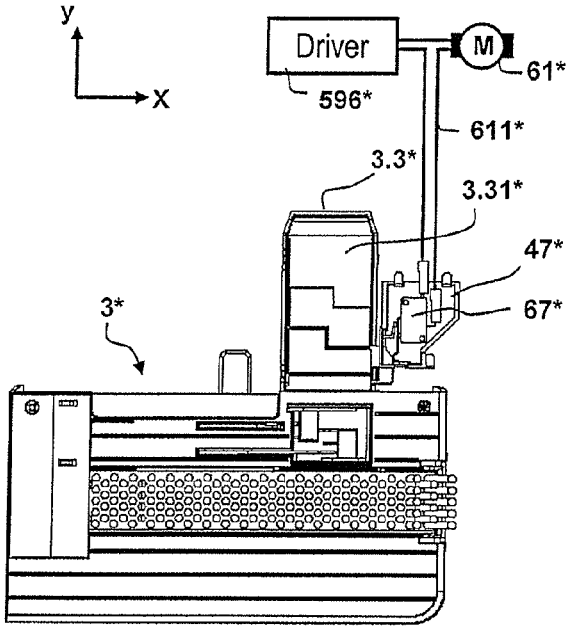
FIG. 9*a* is a plan view of a detail of the apparatus with an inserted box-shaped module.

FIG. 9*a* shows a plan view of a detail of the apparatus with inserted box-shaped module. The detail concerns a plastic support 47* for a microswitch 67* that is used as a sensor to detect the proper insertion of the box-shaped module 3*. The plastic substrate 47* has an installation surface for the microswitch that is situated in the x/y-plane. Since—as shown—the cover 3.31* is mounted so as to be locked on the ink sump reservoir, the microswitch is activated and a circuit is closed with the cable 611* between the first driver 569* and the first motor 61*. An insertion of the box-shaped module 3* is, for example, incorrect if the cover 3.31* has not been placed and fastened on the ink sump reservoir 3.3* before the insertion. The aforementioned circuit is then open.

Figure 9B:
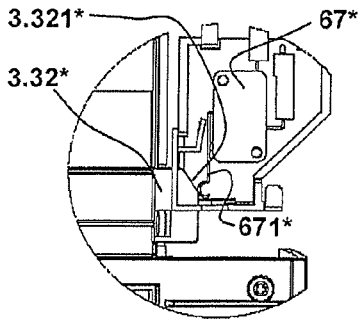
FIG. 9*b* is a plan view of the plastic support of the apparatus with the microswitch in the state during an inserted box-shaped module.

FIG. 9*b* shows a plan view of the plastic support of the apparatus with the microswitch in the state of an inserted and correct box-shaped module. The microswitch 67* used as a sensor has an elastic actuation arm 671* that is operated by a slanted side edge 3.321* of the vane 3.32*. The microswitch 67* emits a signal in order to produce a reactivation of the circuit.

Figure 9C:
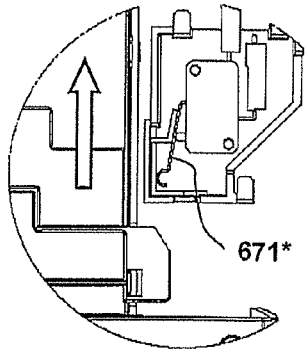
FIG. 9*c* is a plan view of the plastic support of the apparatus with the microswitch in the state during the insertion of the box-shaped module.

FIG. 9*c* shows a plan view of the plastic support of the apparatus with the microswitch in the state during the insertion of the box-shaped module. The elastic actuation arm 671* of the microswitch remains unactivated until the box-shaped module with the properly mounted ink sump cover has been inserted.

Figure 10:
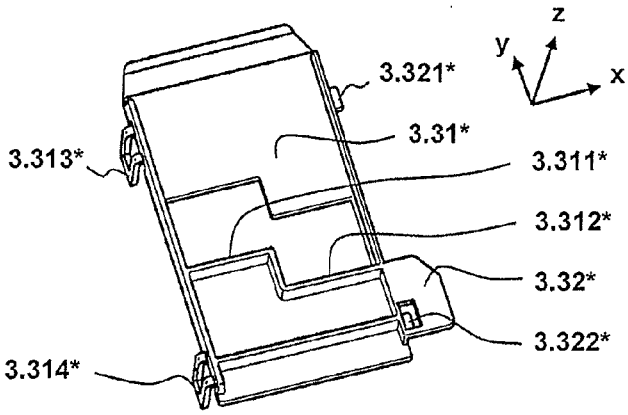
FIG. 10 is a perspective view of the cover.

FIG. 10 shows a perspective presentation of the cover 3.31* which is used to cover the ink sump housing. The cover 3.31* has for each inkjet print head a centrally arranged window 3.311* and 3,312* in order to capture ink vapor or, respectively, the ink residues when the print carriage is moved near to a sealed position. The cover 3.31* has attachment means. For example, a right lateral edge with two cams 3.321* and 3.322* is provided on the side of the vane 3.32*, and two brackets 3.313* and 3.314* are provided on the left lateral edge situated opposite the right lateral edge. The ink sump housing (not shown) has suitable attachment means for positive connection with the aforementioned attachment means of the cover.

The box-shaped module can have an alternative design. For example, one or more mechanical connection elements can be used. The later can also be integrally molded or, respectively, mounted at points on the housing of the box-shaped module other than at the preferred point on the rear wall of said box-shaped module. The locking mechanism of the printing apparatus of modular design is of matching design, corresponding to this.

Although mechanical connection element is designated as a hook in the preferred exemplary embodiment, other alternative mechanical connection elements —such as eye hooks, clips or reinforced hooks designed like boxes and reinforced by side walls, or other connection elements—are not precluded.

A transmitted light sensor is preferred as a first sensor. As an alternative, a microswitch can be used, wherein the microswitch is directly operated by the print carriage as soon as the sealed position is reached.

Although at least one operating means 9.1, 9.2 is connected to the control unit 50 for user input in the preceding exemplary embodiment to switch into the service mode, other user interface alternatives should not be precluded. The display 54 can be a touchscreen that is designed for switching into the service mode by means of the control unit 50.

Additional input and output means can be connected to the electronic control unit.

Although modifications and changes may be suggested by those skilled in the art, it is the intention of the inventors to embody within the patent warranted hereon all changes and modifications as reasonably and properly come within the scope of their contribution to the art.

We claim as our invention:

1. A printing apparatus comprising:

an apparatus housing having a housing bay;

a printing device comprising a print carriage that is movable by a motor, said print carriage comprising at least one ink jet print head;

a transport path in said apparatus housing along which items to be printed by said ink jet print head are transported in a x-direction of a Cartesian coordinate system;

a cleaning and sealing station in said apparatus housing;

a box-shaped module removably inserted in said bay of said apparatus housing, said box-shaped module being configured to urge items in said transport path toward said ink jet print head in order to be printed by said ink jet print head, said box-shaped module comprising a module housing having a housing wall;

a control unit configured to operate said printing device to switch between an operating mode, in which items in said transport path are printed by said ink jet print head and a service mode in which said control unit activates said motor to displace said print carriage in a y-direction of said Cartesian coordinate system and to maintain said printing device in said service mode until said movement of said print carriage causes said ink jet print head to reach a sealed position relative to said cleaning and sealing station;

a locking mechanism that projects into said bay of said apparatus housing;

a mechanical connection element integrally molded on said housing wall of said box-shaped module that interacts with said locking mechanism; and a triggering mechanism operated by said control unit that acts on said locking mechanism with a first force component and a second force component, said triggering mechanism being caused by said control unit in said operating mode to act on said locking mechanism with said first component in a z-direction of the Cartesian coordinate system to engage said locking mechanism with said mechanical connection element to lock said box-shaped element in said bay, and said triggering mechanism being operated by said control unit to act on said locking mechanism in said service mode with said second force component, along said z-direction opposite to said first force component, to cause said locking mechanism and said mechanical connection element to be disengaged to unlock said box-shaped module from said bay to permit removal of said box-shaped module from said bay.

2. A printing apparatus as claimed in claim 1 wherein said mechanical connection element is selected from the group consisting of hooks, eye hooks, loops, and rectangular hooks.

3. A printing apparatus as claimed in claim 1 wherein said module housing wall is a rear wall of said housing of said box-shaped module, and wherein said triggering mechanism is located inside said apparatus housing adjacent said rear wall.

4. A printing apparatus as claimed in claim 1 wherein said triggering mechanism is mounted in said apparatus housing so as to be movable relative to said box-shaped module in said bay, upon being operated by said control unit.

5. A printing apparatus as claimed in claim 1 wherein said control unit comprises a microcomputer and wherein said printing apparatus comprises a user interface in communication with said microcomputer, a sensor that detects when said print carriage is in said sealed position relative to said cleaning and sealing station, and a driver in communication with said microcomputer that operates said motor in response to signals from said microcomputer, and wherein said user interface is configured to allow a user to make an entry that causes said microcomputer, via said driver, to begin to operate said motor to displace said print carriage in said y-direction, and wherein said microcomputer stops said displacement of said print carriage in said y-direction upon receiving a sensor signal from said sensor indicating that said print carriage has reached said sealed position relative to said cleaning and sealing station.

6. A printing apparatus as claimed in claim 5 wherein said sensor is a sensor selected from the group consisting of light sensors and microswitches.

7. A printing apparatus as claimed in claim 1 comprising two guide elements that project from said apparatus housing into said bay, said box-shaped module being configured to engage said guide elements, and said box-shaped module being movable relative to said transport path, and wherein said box-shaped module comprises an opening configured for insertion of an ink sump therein.

8. A printing apparatus as claimed in claim 1 wherein said module housing wall is a rear wall of box-shaped module, and wherein said mechanical connection element is attached at said rear wall, and wherein said apparatus housing has an opening therein into which said mechanical connection element projects when said box-shaped module is inserted in said bay, said locking mechanism being located in said opening and engaging said mechanical connection element.

9. A printing apparatus as claimed in claim 1 comprising a user interface in communication with said control unit configured to allow entry of a user input that causes switching into said service mode.

10. A printing apparatus as claimed in claim 9 wherein said user interface is a touchscreen display.

11. A printing apparatus as claimed in claim 1 comprising a deactivatable connection to a power supply that supplies power to said printing apparatus, said control unit automatically deactivating said connection upon switching to said service mode, and automatically reactivating said connection before again switching into said operating mode.

* * * * *